US009138866B2

(12) United States Patent
Vedantham et al.

(10) Patent No.: US 9,138,866 B2
(45) Date of Patent: Sep. 22, 2015

(54) RESIN BONDED ABRASIVE

(75) Inventors: Ramanujam Vedantham, Worcester, MA (US); Rachana Upadhyay, Shrewsbury, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 589 days.

(21) Appl. No.: 13/504,917

(22) PCT Filed: Oct. 27, 2010

(86) PCT No.: PCT/US2010/054329

§ 371 (c)(1), (2), (4) Date: Jul. 17, 2012

(87) PCT Pub. No.: WO2011/056671

PCT Pub. Date: May 12, 2011

(65) Prior Publication Data

US 2012/0279139 A1 Nov. 8, 2012

Related U.S. Application Data

(60) Provisional application No. 61/255,256, filed on Oct. 27, 2009.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***C09C 1/68*** | (2006.01) |
| ***B24D 3/28*** | (2006.01) |

(52) U.S. Cl.
CPC ..... *B24D 3/28* (2013.01)

(58) Field of Classification Search
USPC ..... 51/293, 298, 307, 309
See application file for complete search history.

(56) References Cited

U.S. PATENT DOCUMENTS

| | | | |
|---|---|---|---|
| 3,422,032 | A | 1/1969 | Figiel et al. |
| 4,944,773 | A | 7/1990 | Rue et al. |
| 4,951,427 | A | 8/1990 | St. Pierre |

(Continued)

FOREIGN PATENT DOCUMENTS

| | | | |
|---|---|---|---|
| CN | 101005925 | A | 7/2007 |
| EP | 0211247 | A2 | 2/1987 |

(Continued)

OTHER PUBLICATIONS

International Search Report for PCT Application No. PCT/US2009/002821 mailed Dec. 30, 2009.

(Continued)

*Primary Examiner* — James McDonough
(74) *Attorney, Agent, or Firm* — Abel Law Group, LLP; Joseph P Sullivan

(57) ABSTRACT

A superabrasive resin product includes a superabrasive grain component, an oxide component, and a continuous phase defining a network of interconnected pores. The oxide component consists of an oxide of a lanthanoid, and the continuous phase includes a thermoplastic polymer component. The superabrasive grain component and the oxide component are distributed in the continuous phase.

20 Claims, 3 Drawing Sheets

(56) References Cited

U.S. PATENT DOCUMENTS

| | | | | |
|---|---|---|---|---|
| 5,129,919 | A | 7/1992 | Kalinowski et al. | |
| 5,152,810 | A | 10/1992 | Rue et al. | |
| 5,212,120 | A | 5/1993 | Araujo et al. | |
| 5,436,063 | A | 7/1995 | Follett et al. | |
| 5,582,672 | A | 12/1996 | Follett et al. | |
| 5,738,696 | A | 4/1998 | Wu | |
| 5,738,697 | A | 4/1998 | Wu et al. | |
| 5,776,290 | A | 7/1998 | Follett et al. | |
| 5,834,109 | A | 11/1998 | Follett et al. | |
| 5,834,569 | A | 11/1998 | Ramanath et al. | |
| 5,863,308 | A | 1/1999 | Qi et al. | |
| 5,891,206 | A | 4/1999 | Ellingson | |
| 6,056,794 | A | 5/2000 | Stoetzel et al. | |
| 6,074,278 | A | 6/2000 | Wu et al. | |
| 6,102,789 | A | 8/2000 | Ramanath et al. | |
| 6,258,136 | B1 | 7/2001 | Kinisky et al. | |
| 6,348,240 | B1 * | 2/2002 | Calvert et al. | 427/539 |
| 6,394,888 | B1 | 5/2002 | Matsumoto et al. | |
| 6,527,854 | B1 | 3/2003 | Prelas et al. | |
| 6,702,867 | B2 | 3/2004 | Carman et al. | |
| 6,709,747 | B1 | 3/2004 | Gordeev et al. | |
| 6,755,729 | B2 | 6/2004 | Ramanath et al. | |
| 6,770,107 | B2 | 8/2004 | Teutsch et al. | |
| 6,913,517 | B2 | 7/2005 | Prasad | |
| 6,915,796 | B2 * | 7/2005 | Sung | 125/21 |
| 7,008,672 | B2 | 3/2006 | Gordeev et al. | |
| 7,090,565 | B2 | 8/2006 | Bonner et al. | |
| 7,294,158 | B2 | 11/2007 | Welygan et al. | |
| 8,216,325 | B2 | 7/2012 | Upadhyay | |
| 8,216,326 | B2 * | 7/2012 | Upadhyay et al. | 51/296 |
| 2001/0000838 | A1 | 5/2001 | Nagata et al. | |
| 2002/0016139 | A1 * | 2/2002 | Hirokawa et al. | 451/54 |
| 2002/0090891 | A1 | 7/2002 | Adefris et al. | |
| 2002/0173259 | A1 | 11/2002 | Drury | |
| 2003/0010780 | A1 | 1/2003 | Redzisz | |
| 2003/0097800 | A1 | 5/2003 | Ramanath et al. | |
| 2003/0192258 | A1 | 10/2003 | Simon | |
| 2003/0194947 | A1 | 10/2003 | Bright et al. | |
| 2003/0194954 | A1 | 10/2003 | Bonner et al. | |
| 2003/0205003 | A1 | 11/2003 | Carman et al. | |
| 2003/0232586 | A1 | 12/2003 | Ramanath et al. | |
| 2004/0137834 | A1 | 7/2004 | Webb et al. | |
| 2004/0166790 | A1 | 8/2004 | Balijepalli et al. | |
| 2004/0185763 | A1 | 9/2004 | Ishizaki et al. | |
| 2004/0247873 | A1 | 12/2004 | Gordeev et al. | |
| 2006/0010780 | A1 | 1/2006 | Hall et al. | |
| 2006/0046622 | A1 * | 3/2006 | Prasad | 451/41 |
| 2006/0135045 | A1 | 6/2006 | Bian et al. | |
| 2006/0137256 | A1 | 6/2006 | Yui et al. | |
| 2006/0211342 | A1 | 9/2006 | Bonner et al. | |
| 2007/0028525 | A1 | 2/2007 | Woo et al. | |
| 2007/0060023 | A1 | 3/2007 | Jeong | |
| 2007/0099548 | A1 | 5/2007 | Kumar et al. | |
| 2007/0261690 | A1 | 11/2007 | Jentgens | |
| 2008/0066387 | A1 | 3/2008 | Bonner et al. | |
| 2008/0085660 | A1 | 4/2008 | Orlhac | |
| 2008/0222967 | A1 | 9/2008 | Querel et al. | |
| 2009/0093198 | A1 | 4/2009 | Subramanian et al. | |
| 2009/0218276 | A1 | 9/2009 | Linford et al. | |
| 2009/0313906 | A1 | 12/2009 | Upadhyay et al. | |
| 2011/0143641 | A1 | 6/2011 | Ramanath et al. | |

FOREIGN PATENT DOCUMENTS

| | | | |
|---|---|---|---|
| EP | 0620083 | A1 | 10/1994 |
| EP | 0963813 | A1 | 12/1999 |
| EP | 1598147 | B1 | 11/2005 |
| EP | 1598147 | A2 | 3/2008 |
| JP | H03-281174 | A | 12/1991 |
| JP | H04-256581 | A | 9/1992 |
| JP | 1996-057768 | A | 3/1996 |
| JP | 1996-257920 | A | 10/1996 |
| JP | H08-253352 | A | 10/1996 |
| JP | H08-257920 | A | 10/1996 |
| JP | 1999-188647 | A | 7/1999 |
| JP | H11-300622 | A | 11/1999 |
| JP | 2000-190232 | A | 7/2000 |
| JP | 2000-301459 | A | 10/2000 |
| JP | 2000-343438 | A | 12/2000 |
| JP | 2003-011066 | A | 1/2003 |
| JP | 2003-136410 | A | 5/2003 |
| JP | 2003-181762 | A | 7/2003 |
| JP | 2004-034173 | A | 2/2004 |
| JP | 2005-319556 | A | 11/2005 |
| JP | 2006-001007 | A | 1/2006 |
| JP | 2006-130635 | A | 5/2006 |
| JP | 2006-334778 | A | 12/2006 |
| JP | 2007-196345 | A | 8/2007 |
| JP | 2007-290101 | A | 11/2007 |
| JP | 2009-061554 | A | 3/2009 |
| WO | 95/19871 | A1 | 7/1995 |
| WO | 98/04385 | A1 | 2/1998 |
| WO | 00/73023 | A1 | 12/2000 |
| WO | 03/099518 | A1 | 12/2003 |
| WO | 2004/011196 | A1 | 2/2004 |
| WO | 2008/117883 | A1 | 10/2008 |
| WO | 2009/128982 | A2 | 10/2009 |
| WO | 2010/008430 | A1 | 1/2010 |
| WO | 2011/056680 | | 5/2011 |

OTHER PUBLICATIONS

International Search Report for PCT/US2009/002839 mailed Feb. 1, 2010.

International Search Report for PCT/US2010/054347 mailed Jul. 26, 2011.

Zhou, Libo et al., "A Novel Fixed Abrasive Process: Chemo-Mechanical Grinding Technology," Int. J. Manufacturing Technology and Management, vol. 7, Nos. 5/6, 2005, Copyright 2005 Inderscience Enterprises Ltd., pp. 441-454.

Technical Search Results, 12 pages, 2009.

International Search Report for PCT/US2010/054329 mailed Jul. 27, 2011.

International Search Report for PCT/US2012/072240 mailed Apr. 25, 2013, 2 pages.

* cited by examiner

RESIN BONDED ABRASIVE

CROSS-REFERENCE TO RELATED APPLICATION

The present application claims priority from PCT Application No. PCT/US2010/054329, filed Oct. 27, 2010, entitled "RESIN BONDED ABRASIVE" naming inventors Rachana UPADHYAY and Ramanujam VEDANTHAM, which in turn claims priority to U.S. Provisional Patent Application Ser. No. 61/255,256 filed on Oct. 27, 2009, entitled "RESIN BONDED ABRASIVE" naming inventors Rachana UPADHYAY and Ramanujam VEDANTHAM, which are all incorporated by reference herein in their entirety.

TECHNICAL FIELD

The disclosure generally relates to a superabrasive product, a superabrasive product precursor to a superabrasive product, and to a method of making a superabrasive product.

BACKGROUND ART

With the global trend of miniaturization, electronic devices are becoming smaller. For semiconductor devices that operate at high power levels, wafer thinning improves the ability to dissipate heat. As final thickness is decreased, the wafer progressively becomes weaker to support its own weight and to resist the stresses generated by post backgrinding processes. Thus, it is important to reduce the damages caused by backgrinding and improve quality.

The original thickness of silicon wafers during chip fabrication is 725-680 μm for 8 inch wafers. In order to obtain faster and smaller electronic devices, the wafers need to be thinned before dicing into individual chips. The grinding process consists of two steps. First, a coarse abrasive wheel grinds the surface to around 270-280 μm, but leaves behind a damaged Si surface, the (backside) surface of the Si wafer. Then, a fine abrasive wheel smoothes part of the damaged surface and grinds the wafer to 250 μm. Wafers with thicknesses down to 100-50 μm are virtually a standard requirement for some IC chip applications. For a long time now the most common thickness in smart cards has been about 180 μm. However, the thinner IC chips are becoming more common in smart cards. Therefore, a need exists for improved grinding tools capable of roughing or finishing hard work pieces, as well as for methods of manufacturing such tools.

DISCLOSURE OF INVENTION

In an embodiment, a superabrasive resin product can include a superabrasive grain component, an oxide component, and a continuous phase. The oxide component can include an oxide of a lanthanoid, and the continuous phase can include a thermoplastic polymer component and a thermoset polymer component. The continuous phase can define a network of interconnected pores. The superabrasive grain component and the oxide component can be distributed in the continuous phase.

In a particular embodiment, the lanthanoid can include an element having an atomic number not less than 57 and not greater than 60, such as lanthanum, cerium, praseodymium, and neodymium. More particularly, the lanthanoid can include cerium, and even can consist essentially of cerium. The oxide of the lanthanoid can be present in an amount in a range of between about 0.05 and about 10 volume percent of the superabrasive resin product.

In another embodiment, a superabrasive product precursor can include a superabrasive grain component, an oxide component, a bond component, and a polymeric blowing agent of encapsulated gas. The oxide component can include an oxide of a lanthanoid.

In yet another embodiment, a method of forming a superabrasive product can include combining a superabrasive, an oxide component consisting of an oxide of a lanthanoid, a bond component, and a polymeric blowing agent of encapsulated gas, and heating the combined superabrasive, bond component, oxide component, and polymeric blowing agent to a temperature and for a period of time that causes release of at least a portion of the gas from encapsulation within the blowing agent.

In still another embodiment, a method of back grinding a wafer can include providing a wafer, and back grinding the wafer to an average surface roughness (Ra) of not greater than 25 angstroms. Grinding can be performed using a superabrasive resin product. The superabrasive resin product can include a superabrasive grain component, an oxide component consisting of an oxide of a lanthanoid, and a continuous phase. The continuous phase can include a thermoplastic polymer component and a thermoset polymer component, and the superabrasive grain component and the oxide component can be distributed in the continuous phase.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
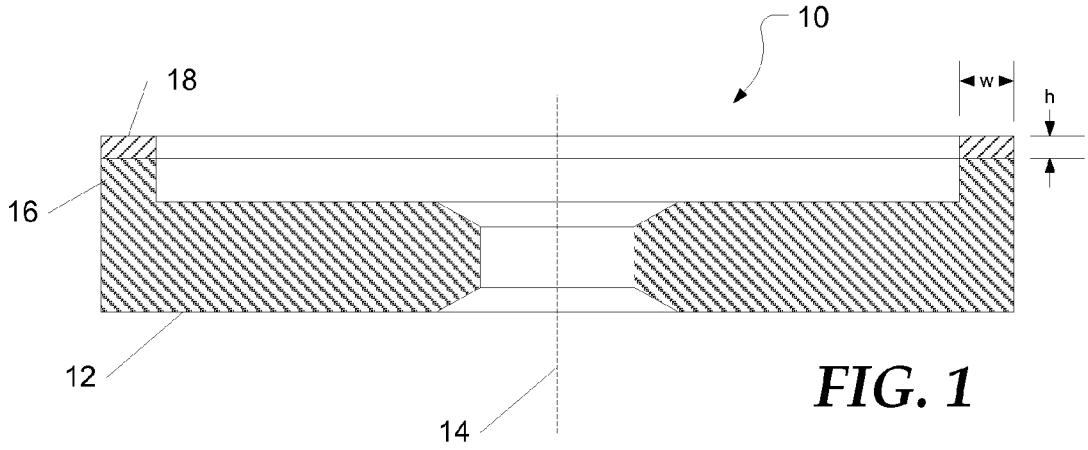
FIG. 1 is a cross-section of an embodiment of a superabrasive resin tool.

In an embodiment, the superabrasive product can include a superabrasive grain component, an oxide component, and a continuous phase that includes a thermoplastic polymer component and a thermoset resin component, wherein the superabrasive grain component and the oxide component is distributed in the continuous phase. The superabrasive grain component can be, for example, diamond, cubic boron nitride, zirconia, or aluminum oxide. The thermoset resin component can include, for example, phenol-formaldehyde. The thermoplastic polymer component can include, for example, polyacrylonitrile and polyvinyledene. Preferably, a superabrasive product can have an open-porous structure, whereby a substantial portion of the pores of the product are interconnected and in fluid communication with a surface of the superabrasive product.

"Superabrasive," as that term is employed herein, means abrasives having hardness, as measured on the Knoop Hardness Scale of at least that of carbon boron nitride (CBN), i.e., a $K_{100}$ of at least 4,700. In addition to cubic boron nitride, other examples of superabrasive materials include natural and synthetic diamond, zirconia and aluminum oxide. Suitable diamond or cubic boron nitride materials can be crystal or polycrystalline. Preferably, the superabrasive material is diamond.

The superabrasive material can be in the form of grain, also known as "grit." The superabrasive grain component can be obtained commercially or can be custom-produced. Generally, the superabrasive can have an average particle size in a range of between about 0.25 microns and 50 microns. Preferably, the particle sizes can be in a range of between about 0.5 microns and 30 microns. In particular embodiments, the average particle size of the grit can be in a range of between about 0.5 microns and 1 micron, between about 3 microns and about 6 microns, such as between about 20 microns and 25 microns.

In one embodiment, the superabrasive grain component can be present in an amount of at least 20% by volume of the superabrasive tool. In another embodiment, the superabrasive grain component can be present in an amount in a range of between about 3% and about 25% by volume of the superabrasive tool, more preferably between about 6% and about 20% by volume of the superabrasive tool. In still another embodiment, the ratio of superabrasive grain component to continuous phase of the superabrasive product can be in a range of between about 4:96 and about 30:70 by volume, or more preferably in a range of between about 15:85 and about 22:78 by volume.

In an embodiment, the superabrasive product can include an oxide of a lanthanoid. The oxide of the lanthanoid can be a compound or complex formed of a lanthanoid element and oxygen. The lanthanoid can include an element of the periodic table having an atomic number of not less than 57 and not greater than 60, such as lanthanum, cerium, praseodymium, and neodymium. Preferably, the lanthanoid can include cerium and may even consist essentially of cerium. The oxide of the lanthanoid can be in an amount in a range of between about 0.05 and about 10 volume percent of the superabrasive product, such as between about 1.0 and about 4 volume percent.

The oxide component can have an average particle size of not greater than about 30 microns, such as not greater than about 25 microns, not greater than about 20 microns, not greater than about 18 microns, or even not greater than about 15 microns. In certain instances, the oxide component can have an average particle size within a range between about 0.1 μm and about 30 μm, such as within a range between about 0.1 microns and about 25 microns, between about 0.1 microns and about 20 microns, between about 0.1 microns and about 18 microns, or even between about 1 micron and about 15 microns.

In an embodiment, the superabrasive product can include a network of interconnected pores. The pores can include large pores having a size of between about 125 microns and about 150 microns, small pores having a size of between about 20 microns and about 50 microns, intermediate pores having a size of between about 85 microns and about 105 microns, or any combination thereof. The pores can have a multimodal size distribution with at least two modes, such as at least three modes. As used herein, a multimodal size distribution is a continuous probability distribution function of particle sizes or pore sizes comprised of two or more modes. Each mode appears as a distinct local maximum in the probability distribution function. The multimodal distribution can has a mode of between about 125 microns and about 150 microns, a mode having an average size of between about 85 microns and about 105 microns, a mode having an average size of between about 30 microns and about 50 microns, or any combination thereof.

Porosity plays an important role in grinding. Porosity controls the contact area between the work piece and the composite microstructure. Porosity facilitates movement of coolant around the microstructure to keep the grinding surface temperature as low as possible. It is important to understand different structures created by using a plurality of different size pore inducers.

Relatively large, e.g., 120-420 nm diameter physical blowing agents generally can yield big pores with relatively few strong bridges. On the other hand, relatively small physical blowing agents between the sizes of 10-80 nm can create a higher number of smaller bridges. A good balance of smaller and larger pore inducers produces a microstructure with advantageous properties found in both microstructures produced exclusively with larger pore inducers and microstructures produced exclusively with smaller pore inducers.

In an embodiment, a superabrasive product can include a superabrasive grain component, an oxide component, and a continuous phase. The continuous phase in which the superabrasive grain component and the oxide component can be distributed can include a thermoplastic polymer component. Generally, the superabrasive tool can be a bonded abrasive tool, as opposed to, for example, a coated abrasive tool.

Examples of suitable thermoplastic polymer components can include at least one member selected from the group consisting of polyacrylonitrile, polyvinyledene, polystyrene and polymethylmethacrylate (PMMA). Examples of preferable thermoplastic polymer components can include polyacrylonitrile and polyvinyledene chloride. In a particularly preferred embodiment, the continuous phase of the superabrasive product can include a combination of polyacrylonitrile and polyvinyledene chloride. In one embodiment, the weight ratio of polyacrylonitrile and polyvinyledene chloride can be in a range of between about 60:40 and about 98:2. In a particularly preferred embodiment, the ratio between polyacrylonitrile and polyvinyledene chloride can be in a ratio of between about 50:50 and 90:10.

The continuous phase of the superabrasive product can also include a thermoset polymer component. Examples of suitable thermoset polymer components for use in the continuous phase of the superabrasive product can include polyphenol-formaldehyde polyamide, polyimide, and epoxy-modified phenol-formaldehyde. In a preferred embodiment, the thermoset polymer component can be polyphenol-formaldehyde.

The volume ratio between thermoplastic polymer component and thermoset polymer component in the continuous phase typically can be in a range of between about 80:15 and about 80:10. In a particularly preferred embodiment, the volume ratio between the thermoplastic polymer component and thermoset polymer component of the continuous phase can be in a range of between about 70:25 and about 70:20. In another preferred embodiment, the volume ratio of thermoplastic to thermoset polymer in the continuous phase can be in a range of between about 50:30 and about 50:40.

Other components of the superabrasive product can include, for example, inorganic fillers like silica, silica gel in a range of between about 0.5 volume percent and about 3 volume percent.

In another embodiment, a superabrasive product precursor to a superabrasive product can include a superabrasive grain component, an oxide component, a bond component, and a polymer blowing agent, wherein the polymer blowing agent encapsulates gas. A preferred superabrasive grain component of the superabrasive product precursor is diamond. The oxide component can be an oxide of a lanthanoid. The bond component can be a thermoset resin component that will polymerize during conversion of the superabrasive product precursor to a superabrasive product. Examples of suitable bond components can include those known in the art, such as phenol-formaldehyde, polyamide, polyimide, and epoxy-modified phenol-formaldehyde.

In one embodiment, the blowing agent can include discrete particles, at least a portion of the particles having a shell that encapsulates gas. Generally, at least a portion of the shells include a thermoplastic polymer. Examples of suitable plastic polymers include polyacrylonitrile, polyvinyledene, such as polyvinyledene chloride, polystyrene, nylon, polymethylmethacrylate (PMMA) and other polymers of methylmethacrylate. In one embodiment, the discrete particles can be of at least two distinct types, wherein each type includes a different composition of thermoplastic shell. For example, in one embodiment, at least one type of discrete particle has a thermoplastic shell that substantially includes polyacrylonitrile. In another embodiment, at least one type of discrete particle has a thermoplastic shell that substantially includes polyvinyledene chloride. In still another embodiment, at least one type of discrete particle of the blowing agent has a thermoplastic shell that substantially includes polyacrylonitrile and another type of discrete particle of the blowing agent has a thermoplastic shell that substantially includes polyvinyledene chloride. In yet another embodiment, at least three distinct types of discrete particles can be present, each distinct type of discrete particles having a thermoplastic shell including a different weight ratio of polyacrylonitrile and polyvinyledene chloride.

Typically, polymeric spheres that encapsulate gas, such as those that include at least one of polyacrylonitrile, polyvinyledene chloride, polystyrene, nylon and polymethylmethacrylate (PMMA), and other polymers of methylmethacrylate (MMA), and which encapsulate at least one of isobutane and isopentane, are available commercially in "expanded" and "unexpanded forms." "Expanded" versions of the spheres generally do not expand significantly during heating to a temperature that causes the polymeric shells of the spheres to rupture and release the encapsulated gas. "Unexpanded" versions, on the other hand, do expand during heating to temperatures that cause the polymeric shells to rupture. Either type of polymeric sphere is suitable for use as a blowing agent, although expanded polymeric spheres are preferred. Unless stated otherwise, reference to sizes of polymeric spheres herein are with respect to expanded spheres.

Often, suitable polymeric spheres that are commercially available are treated with calcium carbonate ($CaCO_3$) or silicon dioxide ($SiO_2$). Examples of suitable commercially available polymeric spheres include Expanded DE 40, DE 80 and 950 DET 120, all from Akzo Nobel. Other examples include Dualite E135-040D, E130-095D and E030, all from Henkel.

In another embodiment, the blowing agent of the superabrasive product precursor includes discrete particles of a shell that includes a copolymer polyacrylonitrile and polyvinyledene chloride. The ratio by weight of polyacrylonitrile to polyvinyledene chloride can be, for example, in a range of between about 40:60 and about 99:1. The average particle size of the blowing agent can be, for example, in a range of between about 10 microns and about 420 microns. In a specific embodiment, the average particle size of a blowing agent can be in a range of about 20 microns and 50 microns. In this embodiment, the weight ratio of polyacrylonitrile to polyvinyledene can be, for example, in a range of between about 40:60 and 60:40. Preferably, the weight ratio of polyacrylonitrile to polyvinyledene chloride in this embodiment is about 50:50.

In another embodiment, the average particle size of the blowing agent is in a range of between 85 microns and about 105 microns. In this embodiment, the weight ratio of polyacrylonitrile and polyvinyledene chloride preferably is in a range of between about 60:40 and about 80:20, with a particularly preferred ratio of about 70:30.

In still another embodiment, the average particle size of the blowing agent is greater than about 125 microns. In this embodiment, the weight ratio of polyacrylonitrile to polyvinyledene chloride preferably is in a range of between about 92:8 and about 98:2, with a particularly preferred ratio of about 95:5.

In an embodiment, the blowing agent can include discrete particles having a multimodal size distribution. The multimodal size distribution can include a mode of between about 125 microns and about 150 microns, a mode of between about 85 microns and about 105 microns, a mode of between about 30 microns and about 50 microns, or any combination thereof.

Examples of encapsulated gas of the discrete particles include at least one member selected from the group consisting of isobutane and isopentane. In the embodiment where suitable gases include at least one of isobutane and isopentane, the size of the discrete particles preferably is in a range of between about 8 microns and about 420 microns, and the wall thickness of the discrete particles encapsulating the gas preferably is in a range of between about 0.01 microns and about 0.08 microns.

The ratio of discrete bodies of the blowing agent to bond component in the superabrasive product precursor generally is in a range of between about 2:1 and about 30:35 by volume. In a specific embodiment, the volumetric ratio is 80:15, and in another embodiment the volumetric ratio is 70:25.

In still another embodiment, a method for forming a superabrasive product can include combining a superabrasive, a bond component, an oxide component, and a polymer blowing agent of encapsulated gas. The combined superabrasive, bond component, oxide component, and polymer blowing agent are heated to a temperature and for a period of time that causes release of at least a portion of the gas from encapsulation within the blowing agent. Typically, the superabrasive is diamond, the bond includes a thermoset, such as phenol-formaldehyde, the oxide component is an oxide of a lanthanoid, and the blowing agent of encapsulated gas includes a thermoplastic shell of at least polyacrylonitrile and polyvinyledene chloride, encapsulating a gas of at least one of isobutane and isopentane.

The combined superabrasive, bond component, oxide component, and polymer blowing agent are heated to a temperature and for a period of time that causes at least a substantial portion of the encapsulated gas to be released from the superabrasive product precursor, whereby the superabrasive product formed has a porosity that is substantially an open porosity. "Open porosity," as defined herein, means that at least a portion, or a substantial portion, of the pores are in fluid communication with each other and with the surface of the superabrasive product. In one embodiment, where between about 70% and about 90% of the volume of the superabrasive product is occupied by pores, the product will be essentially all openly porous. Where the superabrasive product has porosity in a range of between about 40% and about 70%, then a portion of the pores will be closed and the remainder open. In still another embodiment, where porosity is in a range of between about 20% and about 40%, essentially all of the pores will be closed.

In one embodiment, the combined superabrasive, bond component, oxide component, and polymer blowing agent in the form of a superabrasive product precursor, is heated while the superabrasive product precursor is under a positive gauge pressure. Typically, the polymer blowing agent includes a thermoplastic polymer while the bond component includes a thermoset polymer. In one embodiment, the superabrasive product precursor is preheated to a first temperature of at least about 100° C. under pressure of at least two tons. The superabrasive product precursor is then heated from the first temperature to a second, soak temperature, of at least about 180° C. The superabrasive product precursor is then maintained at the soak temperature for at least about 15 minutes to thereby form the superabrasive article. Typically, the superabrasive product precursor is heated to the first temperature, the second soak temperature, and maintained at the soak temperature while the superabrasive product precursor is in a mold, such as is known in the art.

After maintaining the superabrasive product precursor at the soak temperature for a period of time sufficient to form the superabrasive product, the superabrasive product is cooled from the soak temperature to a first reduced temperature, in a range of between about 100° C. and about 170° C. over a period of time in a range of between about 10 minutes and about 45 minutes. The superabrasive product typically is then cooled from the first reduced temperature to a second reduced temperature in a range of between about 30° C. and about 100° C. over a period of time in a range of between about 10 minutes and about 30 minutes.

Typically, the superabrasive product is cooled to the first reduced temperature by air cooling and then cooled from the first reduced temperature to the second reduced temperature by liquid cooling. The superabrasive article is then removed from the mold after being cooled to the second reduced temperature.

In an embodiment, the superabrasive article can be subjected to an optional post-bake process after cool. For example, the superabrasive article can be heated to a temperature of at least about 180° C. for a period of several hours, such as at least about 5 hours, even at least about 10 hours.

In an embodiment, the superabrasive product exhibits strength characteristics, characteristic of a blend of thermoset and thermoplastic polymers. Further, the superabrasive resin product can bind superabrasive grain components, such as diamonds, very effectively, enabling fabrication tools having a wider range of grain component particle size. In addition, the tools can have a relatively high porosity, thereby enabling the tools to be cooled more effectively. As a consequence, grinding of a work piece can be better controlled and wear of the grinding tool is significantly reduced. The superabrasive tool can be fabricated relatively easily, at lower temperatures, for shorter cycles, and under more environmentally friendly conditions, than is common among methods required to fabricate other types of superabrasive tools, such as tools that employ a vitreous bond. Examples of the superabrasive tools can include fixed abrasive vertical (FAVS) spindle-type tools, wheels, discs, wheel segments, stones and hones. In one embodiment, the superabrasive product can be employed in fixed abrasive vertical spindle (FAVS)-type applications.

In one preferred embodiment, the superabrasive resin product is a fixed abrasive vertical spindle (FAVS). An example of a FAVS, is shown in FIG. 1. As shown in the FIG. 1, tool 10 is configured as a wheel having a base 12 about an axis 14. Raised perimeter 16 of wheel supports abrasive segment 18 about the perimeter of base 12. Abrasive segment is one embodiment of a superabrasive product. Typically, base will have a diameter in a range of between about six inches and about twelve inches; the height of the abrasive segment will be in a range of between about 2 millimeters (mm) and about 10 millimeters, such as in a range of between about 5 millimeters and about 8 millimeters, and have a width of between about 2 millimeters and about 4.5 millimeters. Wheels, as described with reference to FIG. 1, are suitable for wafer grinding by rotation about their axis. In a direction counterclockwise to a rotation of the axis of a wafer being ground by the tool.

A Surface Roughness Index can be determined by back grinding a series of silicon wafers. During back grinding, the superabrasive can be rotated at a speed of 5500 rpm while contacting the surface of the wafer with the chuck table rotating at a speed of 80 rpm. The wafer can be ground from a starting thickness of 450 microns to a final thickness of 430 microns. The feed rate of the superabrasive can be 0.80 microns/sec until the wafer thickness is reduced to about 434 microns. The feed rate can then be reduced to 0.50 microns/sec until the wafer thickness if about 430 microns. Upon reaching a thickness of about 430 microns, the feed rate can be reduced to 0.10 microns/sec until the final thickness of 430.0 is achieved.

The Ra (arithmetic average of the roughness profile) of the surface of the wafer can be determined at five points on the wafer including the center and four locations approximately 1 cm from the edge and approximately 90° apart. The Ra for each point can be determined optically at 40× magnification. The readings for each wafer can be averaged to determine the average Ra of each wafer. The average Ra of the wafers can be averaged to determine the Surface Roughness Index, a number that can be associated with a grinding tool of the embodiments herein.

EXAMPLES

Sample 1 is a high porosity resin bonded diamond superabrasive structure made from a mixture of a superabrasive grain, ceria, a resin component, and a polymer blowing agent. Resin used in the microstructures is phenolformaldehyde. The physical blowing agents are PAN and PVDC copolymer spheres from Dualite, of Henkel. The superabrasive grains are diamond having a size of 1-3 microns. The ceria has a size of 3-6 microns. The composition of the mixture in volume percentage, before heating, is: 22.5% diamond, 2% ceria, 29% bond component, and 46.5% of polymer blowing agent.

To make the composite microstructures, material is weighed and mixed by stirring in a stainless steel bowl until a visually homogeneous mix is obtained. The mixture is screened through 165 mesh screen three times (US standard size). It is placed in a steel mold of a suitable design to yield test samples having the following dimensions: 5.020 inches× 1.25 inches×0.300 inches.

Each mixture is filled in the mold by spoon and is leveled in the mold using a leveling paddle. The completely loaded mold package is transported to the electric press. Once the mold package is placed into the press, two tons of pressure is applied, ensuring that the top plate rode into the mold package evenly. The temperature is raised to 100° C. for 15 minutes, then to 150° C. for 10 minutes. The pressure applied to the mold package was compacted. The temperature of the mold package was raised to 180° C., and then soaked for 20 minutes. Once the soak cycle was complete, the press was allowed to cool down to 100° C. by air cooling, followed by water cooling to room temperature. The mold package was removed from the press and transported to the "stripping" arbor press setup. The mold package (top and bottom plates plus the band) was placed onto the stripping arbor, strip band. The plates of the mold and sample were removed and ready to use.

The wheels are tested on a vertical spindle machine having two spindles. The first spindle uses a coarse grinding wheel and the second spindle uses a fine grinding wheel being tested. The silicon wafers are rough ground with a coarse wheel followed by finishing with the fine wheel. The wheel is dressed using an extra-fine pad. The wheels are used to grind 8 inch silicon wafers. The average Ra of the samples is determined to be 21 angstroms.

TABLE 1

| | Surface Roughness (Ra, angstroms) | | | | |
|---|---|---|---|---|---|
| Sample 1 | 19 | 20 | 20 | 24 | 21 |
| Sample 2 | 21 | 21 | 20 | 23 | 23 |
| Sample 3 | 21 | 21 | 22 | 21 | 22 |
| Sample 4 | 23 | 22 | 24 | 22 | 20 |
| Sample 5 | 21 | 21 | 22 | 20 | 20 |

Figure 2:
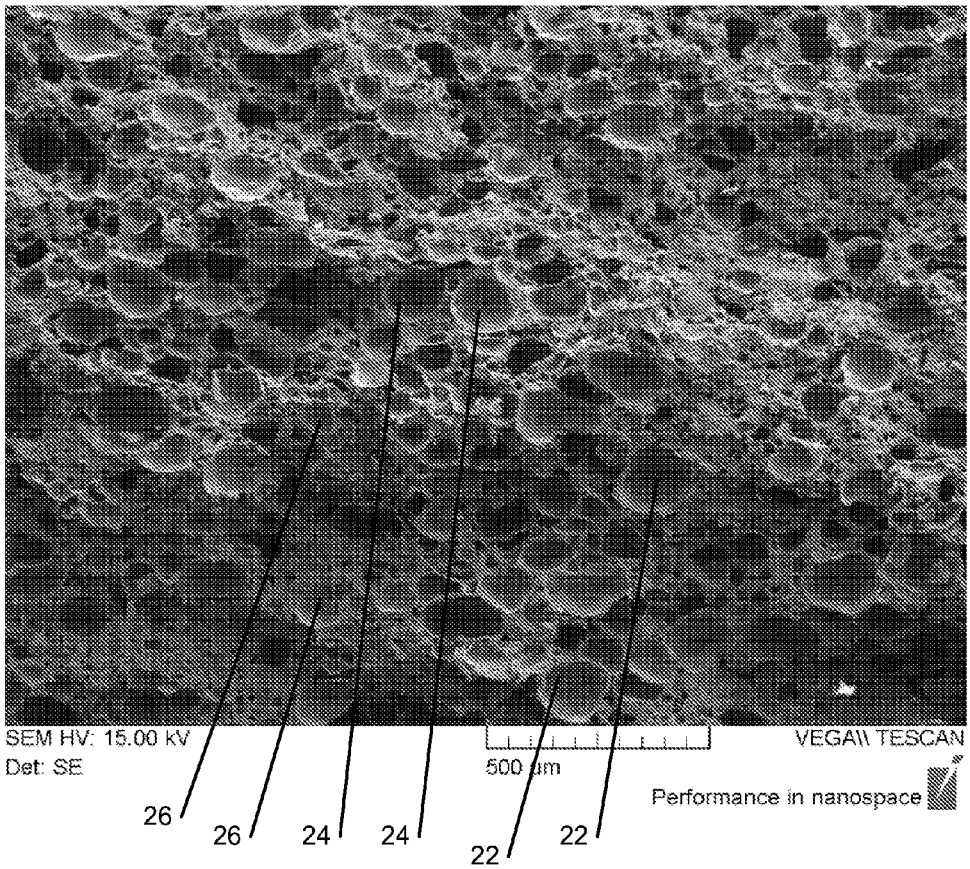
FIGS. 2 and 3 are scanning electron micrographs of an exemplary superabrasive product.
Figure 3:
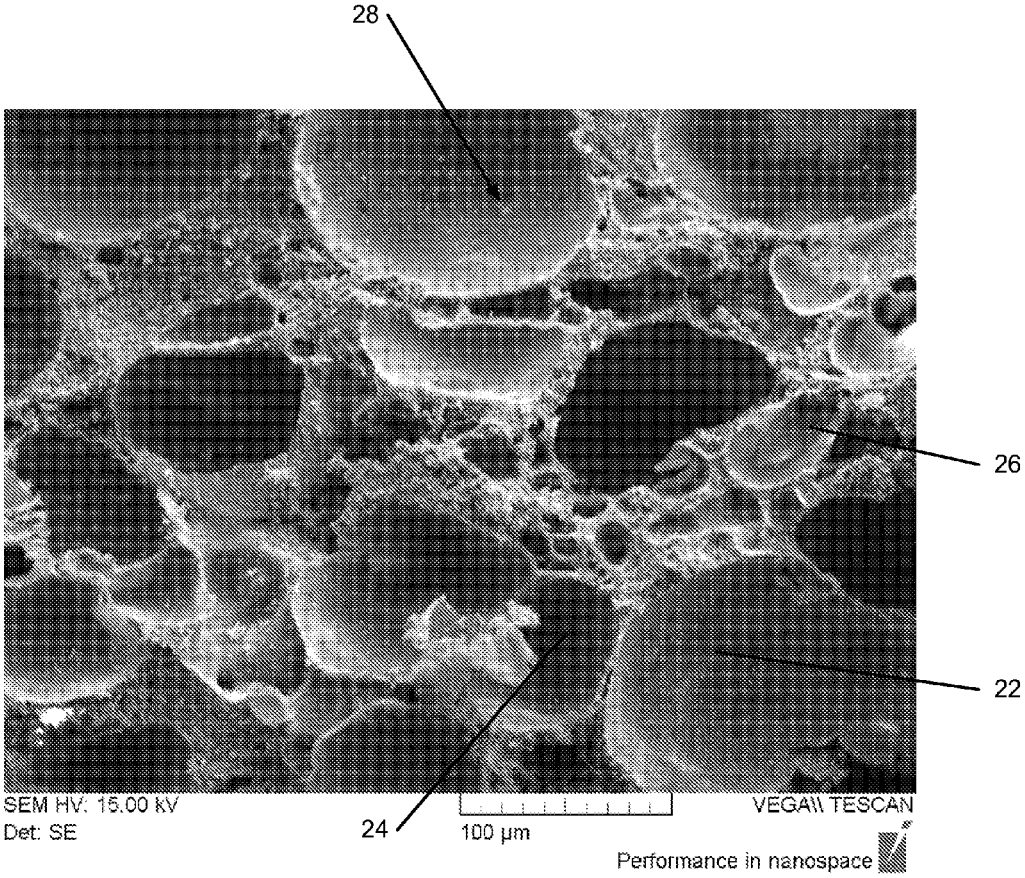

FIGS. 2 and 3 show scanning electron micrographs of the superabrasive product 20. As can be seen in FIG. 2, the superabrasive product includes large pores 22 ranging in size from about 125 microns to about 150 microns, intermediate pores 24 ranging in size from about 85 microns to about 105 microns, and small pores 26 ranging in size from about 20 microns to about 50 microns. As can be seen in FIG. 3, the pores 22, 24, and 26 have an arcuate inner surface that is relatively smooth compared to the surface of the continuous phase outside of the pores. Further, the small particles 28 can be seen on the surface of the pores. The particles can include superabrasive grains and oxide particles.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

The invention claimed is:

1. A superabrasive resin product, comprising: a superabrasive grain component; an oxide component consisting of an oxide of a lanthanoid; and a continuous phase including a bond component, the continuous phase defines a network of interconnected pores, the pores include large pores having a size of between about 125 microns and about 150 microns, small pores having a size of between about 20 microns and about 50 microns, and intermediate pores having a size of between about 85 microns and about 105 microns, wherein the superabrasive grain component and the oxide component are distributed in the continuous phase.

2. The superabrasive resin product of claim 1, wherein the continuous phase includes a thermoplastic polymer component and a thermoset resin component.

3. The superabrasive resin product of claim 2, wherein a ratio of thermoset resin component to thermoplastic polymer component in the continuous phase is in a range of between about 80:15 and about 80:10 by volume.

4. The superabrasive resin product of claim 2, wherein the thermoplastic polymer component includes at least one member selected from the group consisting of polyacrylonitrile, polyvinyledene, polystyrene, nylon, polyethylene, polypropylene and polymethylmethacrylate.

5. The superabrasive resin product of claim 4, wherein the thermoplastic polymer component includes polyacrylonitrile.

6. The superabrasive resin product of claim 4, wherein the thermoplastic polymer component includes polyvinyledene.

7. The superabrasive resin product of claim 6, wherein the polyvinyledene includes polyvinyledene chloride.

8. The superabrasive resin product of claim 7, wherein the thermoplastic polymer component includes polyacrylonitrile and polyvinyledene chloride.

9. The superabrasive resin product of claim 8, wherein the ratio of polyacrylonitrile to polyvinyledene chloride is in a range of between about 1:1 and about 98:2 by weight.

10. The superabrasive resin product of claim 2, wherein the continuous phase further includes a thermoset polymer component and the thermoset polymer component includes at least one member selected from the group consisting of polyphenolformaldehyde, polyamide, polyimide and epoxy-modified phenolformaldehyde.

11. The superabrasive resin product of claim 1, wherein a ratio of continuous phase to superabrasive grain component is in a range of between about 2:1 and about 1:2 by volume.

12. The superabrasive resin product of claim 1, wherein the superabrasive resin product has a porosity in a range of between about 30% and about 80% by volume.

13. The superabrasive resin product of claim 1, wherein the oxide component is present in an amount in a range of between about 0.05 and about 10.0 volume percent of the superabrasive resin product.

14. The superabrasive resin product of claim 1, wherein the oxide component has an average particle size in a range of between about 0.1 and about 10.0 microns.

15. The superabrasive resin product of claim 1, wherein the lanthanoid includes cerium.

16. The superabrasive resin product of claim 1, wherein the lanthanoid consists essentially of cerium.

17. The superabrasive resin product of claim 1, wherein the continuous phase is a substantially open continuous phase.

18. The superabrasive resin product of claim 1, wherein the superabrasive grain component includes at least one member selected from the group consisting of diamond, cubic boron nitride, zirconia, and aluminum oxide.

19. The superabrasive product of claim 1, wherein the superabrasive grain component includes diamond.

20. The superabrasive product of claim 1, wherein the superabrasive grain component has a median particle size in a range of between about 0.25 μm and about 30 μm.

* * * * *